United States Patent [19]

Sigmund et al.

[11] 4,308,977

[45] Jan. 5, 1982

[54] DISPENSING DEVICE WITH ONE-HAND OPERATION FOR PASTY SUBSTANCES

[75] Inventors: Ludwig Sigmund, Pfungstadt; Norbert Golzer, Darmstadt-Eberstadt; Franz Steigerwald, Griesheim, all of Fed. Rep. of Germany

[73] Assignee: Wella Aktiengesellschaft, Darmstadt, Fed. Rep. of Germany

[21] Appl. No.: 133,135

[22] Filed: Mar. 24, 1980

[30] Foreign Application Priority Data

Mar. 24, 1979 [DE] Fed. Rep. of Germany ... 7908402[U]
Mar. 20, 1980 [DE] Fed. Rep. of Germany ... 8007552[U]

[51] Int. Cl.[3] ..... B65D 88/58
[52] U.S. Cl. ..... 222/320; 222/386
[58] Field of Search ..... 222/320, 323, 326, 327, 222/386, 391; 401/177; 128/218 R, 218 F, 237

[56] References Cited

U.S. PATENT DOCUMENTS

| | | | |
|---|---|---|---|
| 627,522 | 6/1899 | Patterson | 222/320 |
| 1,214,801 | 2/1917 | Linke | 222/320 |
| 1,223,172 | 4/1917 | Jacobson | 222/320 |
| 1,591,604 | 7/1976 | Bienenstok | 222/320 |
| 1,948,054 | 2/1934 | Stringfellow | 222/320 |
| 2,023,820 | 12/1935 | Pustejovsky | 222/320 |
| 2,834,538 | 5/1958 | Sugrue et al. | 222/320 |
| 3,208,645 | 9/1965 | Rayner | 222/320 |

FOREIGN PATENT DOCUMENTS

| | | | |
|---|---|---|---|
| 246232 | 1/1926 | United Kingdom | 222/386 |

*Primary Examiner*—H. Grant Skaggs
*Attorney, Agent, or Firm*—Michael J. Striker

[57] ABSTRACT

A dispensing device for applying a pasty substance, for example to a human hair, comprises a cup-shaped cylindrical container and a piston located therein and displaceable within the container. The container is sealingly connected to an operating extension having a cylindrical passage terminated with a dispensing nozzle which is selectively closed by a sealing cap. The piston is formed with two sealing lips spaced from one another in the axial direction and outwardly and angularly extending from the periphery of the piston so that one of the lips sealingly connects the piston to the internal wall of the container whereby the second lip is adapted to reliably guide said piston within the container.

18 Claims, 9 Drawing Figures

Fig.1
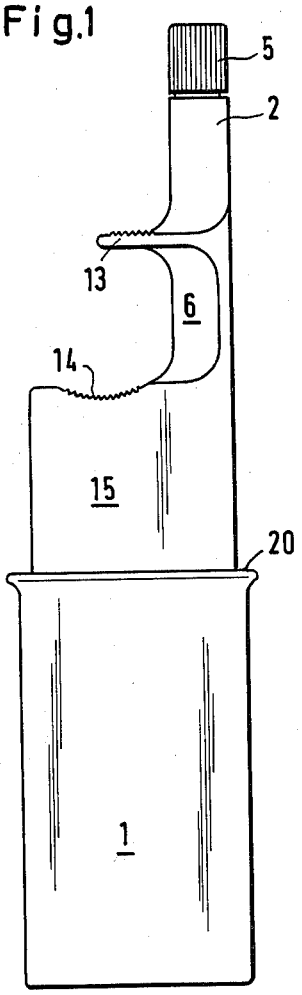
Fig.2
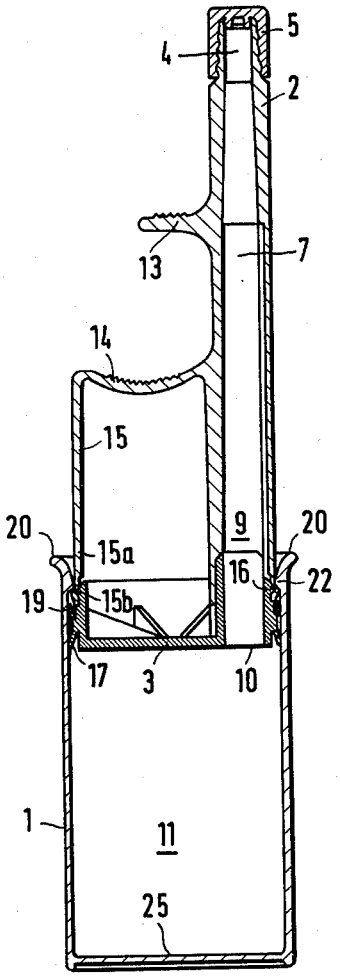
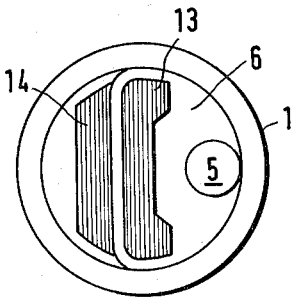
Fig.3

Fig.4
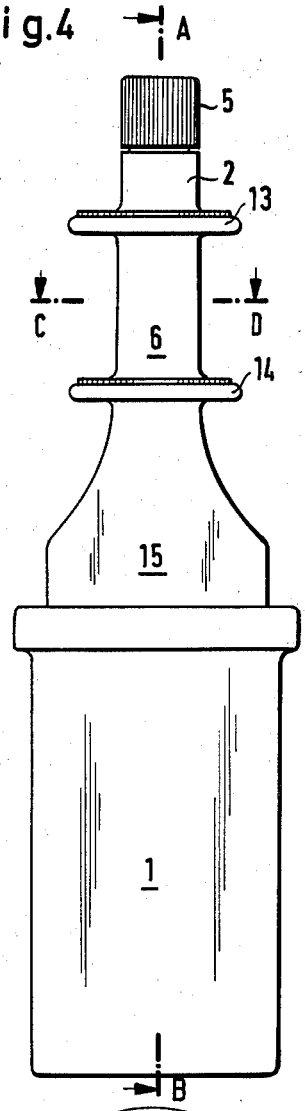
Fig.5
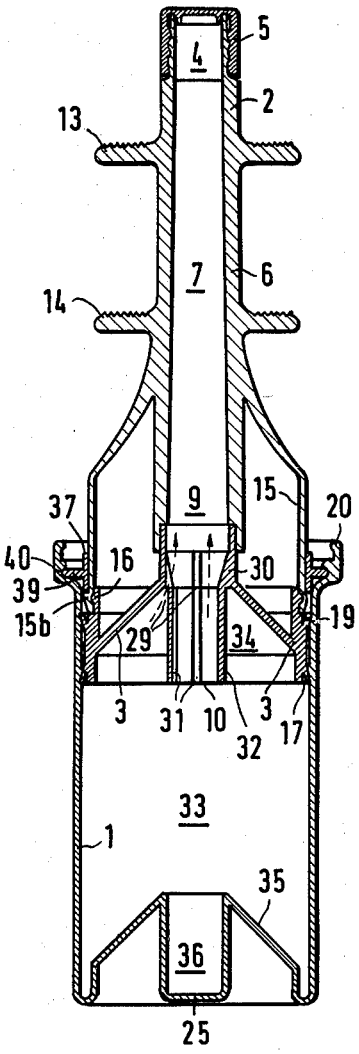
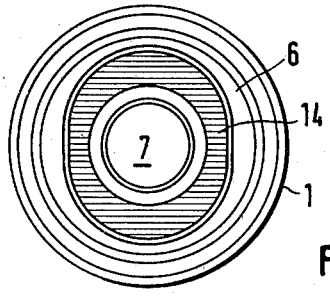
Fig.6

Fig. 7
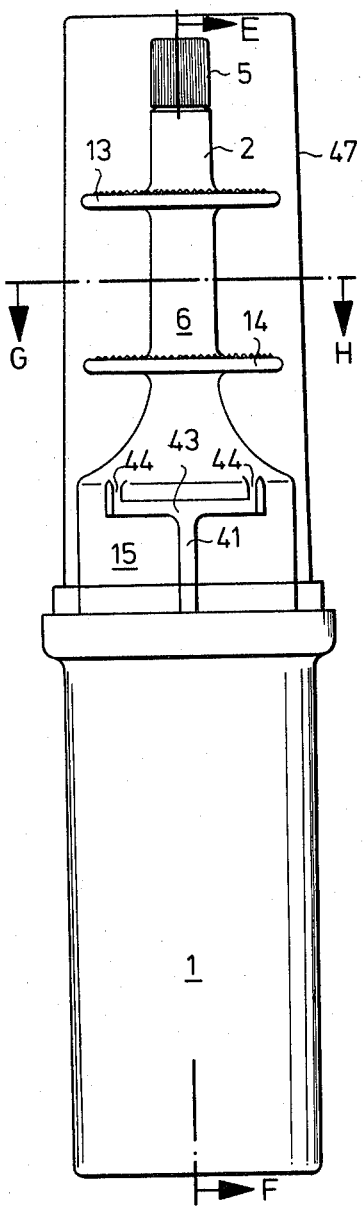
Fig. 8
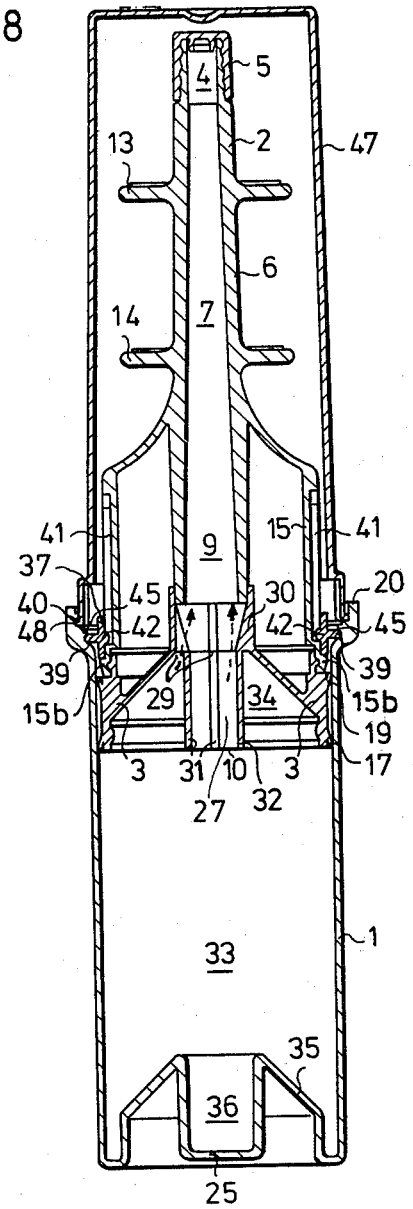
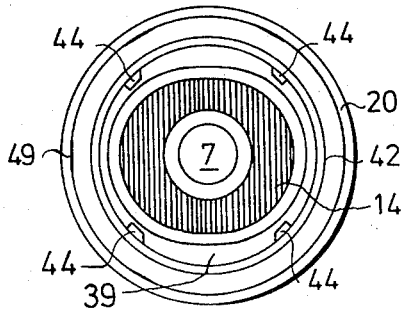
Fig. 9

DISPENSING DEVICE WITH ONE-HAND OPERATION FOR PASTY SUBSTANCES

BACKGROUND OF THE INVENTION

The invention relates to a dispensing device with one-hand operation for pasty substances, comprising a cup-shaped container for holding the pasty substance forming a cylinder, a piston axially displaceable within the container sealing means fixedly attached to the piston acting conjointly with the internal wall of the container an operating extension fixedly attached to the piston and extending in the axial direction provided with two grip handles arranged in parallel at a distance to each other and vertical to its longitudinal axis.

Various dispensing devices have become known, for instance as described in the German DE 10 69 849 publication, wherein the container is provided with a superimposed component in which the operating extension is supported axially displaceable, its two grip handles radially extending outward in the zone of an axial longitudinal slot. Such dispensers, however, have not proven fully satisfactory in use.

SUMMARY OF THE INVENTION

It is an object of the invention to provide a novel construction of a one-hand operated dispensing device, particularly for the application of pasty substances onto body areas, for instance in hair care, wherein simple measures of design will make the device suitable for many applications and allow simple filling of it by the manufacturer, preferably as one-way packing.

As per this innovation, this and other objects are achieved by an operating extension extending beyond the open end of the container and being freely accessible from the exterior, by a dispensing nozzle being selectively closable by a sealing cap closure, by sealing means of the piston being formed by a first sealing lip around the periphery projecting radially outward at an angle from the periphery of the piston and distant from the open end of the container, and by guiding means of the piston being formed by a second sealing lip around the periphery, projecting radially outward from the peripheral zone of the piston adjacent to the open end of the container in the direction towards this open end.

It will be favorable for one purpose of application, if the essentially cylindrical passage of the operating extension is arranged eccentrically to the piston, and if both its grip handles are, respectively, constructed symmetrically relative to the longitudinal axis of the cylindrical passage.

This will allow that in any desired axial position the fingers may depress the grip handles towards the bottom of the container, whereby the pasty substance may be dispensed through the dispensing nozzle.

It will be suitable for some applications, particularly when the strand to be dispensed is to have a differently striped coloring to better distinguish different products of the same color, to provide the piston with an extension in the shape of a hollow cylinder axially extending into the interior of the container and to provide this cylindrical extension in the zone of its end that is joined to the piston, with at least one, preferably five, cutouts connecting the interior of the cylindrical passage of said operating extension with the hollow space surrounding said cylindrical extension. Further developments and embodiments of the invention are identified in the subordinate claims, and will be described below with reference to the Figures showing partially simplifying schematics representing two embodiments. In the aforesaid, identical parts are identically referenced and all details not required for comprehending the innovation have been omitted.

BRIEF DESCRIPTION OF THE DRAWINGS

FIG. 1 is a side view of a dispensing device as per invention, with an eccentrically arranged dispensing nozzle;

FIG. 2 is a radial longitudinal section through the plane of the drawing of the embodiment shown in FIG. 1;

FIG. 3 is a top view of the embodiment shown in FIG. 1;

FIG. 4 is a side view of a second embodiment of the dispensing device as per invention, with concentrically arranged dispensing nozzle;

FIG. 5 is a radial, longitudinal, section through the embodiment shown in FIG. 4, along the line A—B;

FIG. 6 is a cross section along the line C—D of the embodiment shown in FIG. 4;

FIG. 7 is a side view of a third embodiment, with the concentrically arranged dispensing nozzle of FIG. 4;

FIG. 8 is a radial cross section through the embodiment shown in FIG. 7, along the line E—F; and FIG. 9 is a cross section through line G—H of the embodiment shown in FIG. 7.

DETAILED DESCRIPTION OF THE PREFERRED EMBODIMENTS

The dispensing device shown in FIG. 1 consists of a container 1 for holding a pasty substance, which forms the cylinder, and an internally located piston 3 bearing the dispensing nozzle 2. The end 4 of the dispensing nozzle 2 shown on top in FIGS. 1 and 2 is closable by a screwed cap 5. The dispensing nozzle 2 is a component of the operating extension 6 provided with an internally located, essentially cylindrical, passage 7, said passage being eccentrically located relative to the piston axis, the lower end 9 of said passage being in connection with the internal space of the container 1 over the aperture 10. The upper end of said passage may optionally be closed by means of the screwed cap 5. The operating extension 6 is provided with two grip handles 13, and, respectively 14, arranged parallel at a distance from each other and vertically spaced from one another relative to its longitudinal axis, wherein the grip handle 13 will radially project towards the longitudinal axis of the piston whilst the grip handle 14 located below is fixedly connected with a cylindrically shaped center part 15 of the operating extension 6.

The width of the upper grip handle 13—measured radially—will herein be about half of the width of the lower grip handle 14. The two grip handles 13, and, respectively 14, are provided with longitudinal grooves at their side away from the piston. The open end **15*a* of the cylindrical central part 15, shown in FIGS. 1 and 2 at the lower position, supports the piston 3 which is held therein by means of its peripheral collar 16. The open end 15*a* of the cylindrical central portion 15 is furthermore provided with a circular rib 15*b* radially projecting outward. The piston 3 is provided with two circular sealing lips 17 and 19, extending away from each other, from the peripheral zone of the piston, forming thereby an angle with the longitudinal axis of at least 10°, preferably 15°. The largest external diameter of these sealing lips 17 and 19 will be larger by at least 0.1 mm, preferably 0.2 mm, than the smallest internal diameter of the internal space 11 of the container 1 in the zone of the axial movement of the stroke. The lower end 9 as per FIG. 2 is in communication with a concentrically arranged cylindrical extension of the piston 3 which forms the aperture 10**.

The open end 20 of the container 1, facing the dispensing nozzle 2, is provided with a circular, radially inward-pointing projection 22, the smallest internal diameter of which being smaller by about 0.1 mm than the largest external diameter of the circular sealing lips 17, or, respectively 14, when not yet installed.

Functioning is as follows:

During the filling sequence at the producer, the container 1 is filled with a pasty substance, e.g. a paste for hair care; the piston 3 preassembled with the operating extension 6, is then pressed in by a pressing sequence, until the circular rib 15*b*, of the cylindrical central part 15, shown on top in FIG. 2, will engage behind the circular projection 22. The screwed cap 5 is then screwed on. The dispensing device thus filled and assembled may now be stored and sold.

The user who, for instance, desires to treat his hair with it, will unscrew the screw cap 5, hold the dispensing device in his hand in such a manner that the fingers will hold the cylindrical external wall and the bottom 25 of the container 1, and the thumb will rest upon the lower grip handle 14. The user will now hold the dispensing device over his head—with the dispensing nozzle 4 directed down towards the head—and by pressing the hand together, the paste will be expelled from the internal space 11 of the container and through the aperture 10 into the cylindrical passage 7 and out of there, thus applying the paste onto the hair portion to be treated. As soon as the grip handle 14 has reached the zone of the open end 20 of container 1, the thumb may change onto the upper grip plate 13, whilst the expelling sequence may be continued without interruption and without using a second hand, until the contents of the container have been completely dispensed.

The second embodiment shown in FIGS. 4 to 6 is essentially of the same function and of similar construction. Deviating from the aforesaid, the cylindrical passage 7 is herein in concentrical arrangement within the operating extension 6, the end 9 of which, in the lower position in FIG. 5, being in communication with a concentrically arranged hollow cylindrical extension 27 of the piston 3, which forms the aperture 10. This hollow cylindrical extension 27 extends away from the piston 3 to the interior of the container 1, the internal diameter of the first-said being less than the internal diameter of the adjacent end 9 of the circular passage 7. The cylindrical passage extension 27 is provided with five cutouts 29 in the zone of its end connected to the piston 29, said cutouts being arranged in such a manner that they are communicating in the zone of transition from the smaller diameter of the cylindrical extension 27 to the larger diameter of its cylindrical transition piece 30 which is connected to the lower end 9 of the cylindrical passage 7 by a sealing joint. Longitudinal ribs 31, radially projecting inward, are provided at the internal side of the cylindrical extension 27, extending respectively from each cutout 29 up to the end 32 of the cylindrical extension 27 which projects into the container 1. The paste to be applied is accommodated within the essentially cylindrical internal space 33 of container 1, whilst a paste of requisite different coloration is accommodated within the hollow space 34 formed between the essentially tapering zone of piston 3 and the cylindrical extension 27. On expelling, the paste is pressed from the cylindrical internal space 33 through the passage formed by the cylindrical extension 27, whilst the differently colored paste is pressed from the hollow space 34 through the cutouts 29 and into the cylindrical passage 7. In the arrangement the cutouts 29 and the longitudinal ribs 31 are so selected herein that a strand of paste will result which, upon exiting from the dispensing nozzle 4, will consist of five uniformly spaced longitudinal stripes of differing colors. The longitudinal ribs 31 within the cylindrical extension 27 serve herein to provide space for the differently-colored paste subsequently added through the cutouts 29.

In order to limit the quantity remaining in the cylindrical interior space 33 of the container after the maximum stroke of the piston 3, its bottom is of a shape adapted to the piston. For this purpose, the bottom 25 is provided with an inward-tapering zone 35 with a cylindrical recess 36 arranged concentrical to the longitudinal axis, the inner diameter of the latter being somewhat smaller than the external diameter of the cylindrical extension 27. At the end of the stroke of the piston 3, the cylindrical extension 27 will be located within the cylindrical recess 36, with the tapering zone of the piston 3 firmly abutting the inwardly tapering zone 35 of the bottom.

As can be seen from FIGS. 4 to 6, the two grip handles 13 and 14 are, respectively, designed in symmetry to the longitudinal axis of the cylindrical passage 7 and are of about the same dimensions. This will result in the advantage that several individually usable positions are available in which the dispensing device may be held and operated, as shown in FIG. 5, the circular rib 15*b* at the open end of the cylindrical central part 15 will radially protrude not as far as the one shown in FIG. 2, wherein its longest external diameter will be somewhat smaller than the smallest internal diameter of the circular projection 22 on the container 1. Thus, the operating extension 6 may be pushed with facility into the interior of the container 1. A holding ring 37 may now be slid upon the cylindrical part 15, the face of the holding ring facing the container 1, acting here conjointly with the circular rib 15*b* as stop for limiting the stroke of the cylindrical central part 15. The holding ring 37 is provided with a projection 39 of radial outward orientation, which acts as a detent element conjointly with a groove 40 provided at the periphery of the container. This holding ring 37 will concomitantly serve to prevent unauthorized or, respectively inadvertent actuation of the operating extension 6 with the piston 3. Withdrawing of the operating extension 6 will only be possible by using strong force and by destroying the holding ring, so that after a possible unauthorized refilling of the container, correct assembly is not possible any more if the holding ring has been destroyed.

As protection against inadvertent operation of the dispensing nozzle during transportation, a cylindrical hood 47, not shown in FIGS. 4 to 6, may be set over the dispensing nozzle 2, the open end of the former having an outwardly projecting peripheral ring 48 which in turn will engage behind lobes 49 radially projecting inward at the open end 20 of the container 1, as represented in the third embodiment in FIGS. 7 and 8. Upon use, the cylindrical hood 47 may be pulled off by tilting it slightly and it may be put in place any time by axially pressing it on.

The operating extension 6 is provided with two first longitudinal grooves 41 at the exterior of its cylindrical central part 15, the grooves acting conjointly with one respective opposite nose 42 of a holding ring 37 projecting radially inward, wherein the length of these first longitudinal grooves 40 will amount to at least 20% of the maximum stroke length. At the end of the first longitudinal groove 41 not facing the container 1, a lateral groove 43 tangentially extending in both directions is provided, with a second longitudinal groove 44 extending from the respective end of the former in a direction away from the container 1, as is better evident from FIGS. 7 and 9.

The holding ring 37 is retained in the container 1 by a projection 49 arranged at its open end 20 and radially projecting inward. The end of the operating extension 6 facing the piston 3 is furthermore provided with a peripheral rim 46 of an outer diameter larger than the smallest inner diameter of the holding ring 37, as better evident from FIG. 8. After completed assembly, the holding ring 37 pressed-in axially within the open end of the container 1, will secure the operating extension 6 against inadvertent withdrawing.

It will be understood that each of the elements described above, or two or more together may also find a useful application in other types of a dispensing device differing from the types described above.

While the invention has been illustrated and described as embodied in dispensing devices, it is not intended to be limited to the details shown since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A dispensing device with one-hand operation for pasty substances, comprising a cup-shaped cylindrical container for a pasty substance; a piston having a peripheral wall and being displaceable within said container, said container having a longitudinal axis and an internal wall defining the interior of the container and terminated with an open end; sealing means fixedly attached to said piston and adapted to conjointly act with said internal wall; an operating extension fixedly attached to said piston and extending in an axial direction beyond said open end to be freely accessible from outside of said container; two grip handles formed on said operating extension; said operating extension including a central part provided with an internal cylindrical passage having one end communicating with said interior of the container and another end provided with a dispensing nozzle; means for guiding said piston parallel to said axis; and a sealing cap selectively closing said dispensing nozzle, said sealing means including a first sealing lip formed on said piston distant from said open end and outwardly and angularly extending from said peripheral wall, said guiding means including a second sealing lip formed on said piston and outwardly and angularly extending from said peripheral wall, said second lip being spaced from said first lip in the axial direction and being formed adjacent said open end, said internal wall including a projection radially inwardly extending therefrom said positioned in the vicinity of said open end, said central part having a peripheral rib adapted to engage with said projection.

2. The device of claim 1, wherein said first and second lip extend at an angle at least 10° to said longitudinal axis.

3. The device of claim 1, wherein said cap is threaded on said dispensing nozzle.

4. The device of claim 1, wherein said cap is press fitted on said dispensing nozzle.

5. The device of claim 1, wherein said cylindrical passage is disposed eccentrically of said longitudinal axis of said container.

6. The device of claim 5, wherein one of said grip handles is adjacent to said central part of said operating extension, said grip handles extending in a radial direction of said cylindrical passage, the other of the grip handles being spaced from said one handle in the axial direction and having a length in a radial direction being relatively smaller than that of said one handle.

7. The device of claim 1, wherein said cylindrical passage is disposed concentrically of said longitudinal axis of said container.

8. The device of claim 7, wherein said two grip handles extend radially symmetrically of said longitudinal axis.

9. The device of claim 8, further including a hollow cylindrical extension concentrical with said longitudinal axis and projecting into said interior of said piston, said hollow extension being formed with a number of cutouts located in the area of connection of said hollow extension with said piston, said cutouts forming a hollow space within said piston and adapted to connect said cylindrical passage to said container.

10. The device of claim 9, wherein the internal diameter of said hollow extension is relatively smaller than the internal diameter of said cylindrical passage in the area of their connection.

11. The device of claim 10, wherein said hollow extension is formed with a plurality of longitudinal ribs respectively extending from said cutouts to form a number of channels for accommodation of various pasty substances.

12. The device of claim 7, including a holding ring forming said projection engageable with said peripheral rib and provided with a nose radially inwardly projecting toward said longitudinal axis, said central part further including at least one first longitudinal groove adapted to act cojointly with said nose, a second groove extending perpendicularly from said first groove and connected thereto, and a third longitudinal groove connected to said second groove and extending parallel to said first longitudinal groove in the direction away from said longitudinal axis.

13. The device of claim 12, wherein two first longitudinal grooves are formed on said central part, said grooves being diametrically opposite one another.

14. The device of claim 13 wherein said second groove extends perpendicularly of said first grooves in both opposite directions of the ends of said grooves.

15. The device of claim 14, wherein said holding ring has a projection extending radially outwardly from the periphery of said ring, said internal wall of said container at said open end being formed with a groove adapted to conjointly act with said projection of said ring to secure said operating extension against inadvertent withdrawing.

16. The device of claim 15, wherein said operating extension being formed with a peripheral rim facing said piston, the external diameter of said rim being greater than the smallest internal diameter of said holding ring.

17. The device of claim 12, wherein the length of said first longitudinal groove is selected so that it corresponds to at least 33% of the maximum stroke of said piston.

18. The device of claim 1, wherein the diameter of said peripheral rib is somewhat larger than the diameter of said projection.

* * * * *